US005678504A

United States Patent [19]

Toplosky et al.

[11] Patent Number: 5,678,504

[45] Date of Patent: Oct. 21, 1997

[54] NEGATIVE LIFT DEVICE FOR TOW CABLE FAIRING

[75] Inventors: Norman Toplosky, Voluntown, Conn.; Anthony A. Ruffa, Hope Valley, R.I.

[73] Assignee: The United States of America as represented by the Secretary of the Navy, Washington, D.C.

[21] Appl. No.: 668,604

[22] Filed: Jun. 3, 1996

[51] Int. Cl.[6] ..... F15D 1/10

[52] U.S. Cl. ..... 114/243

[58] Field of Search ..... 114/243, 244; 405/211, 216

[56] References Cited

U.S. PATENT DOCUMENTS 3,224,406 12/1965 Clark ..... 114/243

3,611,976 10/1971 Hale ..... 114/243

4,075,967 2/1978 Silvey ..... 114/243

*Primary Examiner*—Jesus D. Sotelo

*Attorney, Agent, or Firm*—Michael J. McGowan; Prithvi C. Lall; Michael F. Oglo

[57] ABSTRACT

A towing cable is fitted with segmented fairings, each segment being further provided with a negative lift vane that is adjustable in orientation relative to the axis of the cable. Each vane has a channel shaped wing with the legs of the channel defining winglets one of which is attached at the inboard end of the wing to a strap that is pivotally mounted to the fairing at a point immediately behind or after the cable. The other end of the strap is releasably secured to the trailing edge of the fairing for locating the vane at a desired angle relative to the axis of the cable on which the fairing is mounted.

5 Claims, 5 Drawing Sheets

NEGATIVE LIFT DEVICE FOR TOW CABLE FAIRING

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION (1) Field of the Invention

The present invention relates to improvements for tow cable fairings, and deals more specifically with a negative lift device that is adapted to be adjustably secured to the fairing for depressing the cable while the cable at the same time is fitted with segmented fairings throughout a major portion of its length.

(2) Description of the Prior Art

Negative lift devices for submerged towed cables have taken many forms. For example, Moore Pat. No. 5,000,110 shows a cable depressor in the form of a negative lifting body for attachment to a cable at any one of several attachment points on the body depending upon the degree of negative pitch desired between the free stream direction of the fluid through which the cable is towed and the longitudinal axis of the negative lift body itself.

Warnan et al., U.S. Pat. No. 4,991,534 shows a negative lift depressor for a towed cable that is secured to the cable by means of a harness with three suspension cables connected respectively to the forward end of the device and the trailing edges of the wing tips.

Pickett et al., U.S. Pat. No. 4,463,701 show a towed body at the end of the cable with depth sensing means provided and movable wings or fins that are operated in response to a control system for maintaining a predetermined depth for the body as the body is towed by the cable.

Blaisdell, Pat. No. 4,252,074, shows a cable fitted with spaced lifting devices which are provided at a fixed angle relative to the longitudinal axis of the cable. Each device has a crescent shaped wing as well as a trailing tail section to impart lift to the cable such that the trailing end of the cable approaches the surface of the water when towed by a submarine and thereby facilitates radio communications to or from the submarine.

Haberman, Pat. No. 3,645,224, shows an underwater negative lift body with the attachment point being adjustable to control the degree of pitch of the device relative to the towing cable.

Finally, Pat. No. 3,611,976 issued to Hale et al. shows segmented fairings for a towed cable. These fairings are intended to reduce the lateral vibration or strum of the cable as it is towed through the water at an angle which would otherwise create a high drag fluid flow pattern around the cylindrical cable. Since tow cables must be wound aboard ship on a drum, Hale shows these fairings to be in the form of segments. In subject patent the fairings are linked to one another for ease in storing of the cable on the drum.

The above described lifting bodies suffer disadvantages when a single such device is relied upon for depressing a towed cable deployed from a surface vessel. The limitation imposed by attempting to achieve the negative lift from a single point on the cable, usually at the lowermost end, has been found to make excessive demands on the design of the depressor body itself. The very wide variety of such depressor bodies as disclosed in the prior art is testimony to this fact. Blaisdell has suggested distributing a plurality of lifting devices along the cable. Although used for somewhat different purpose these devices do provide a greater degree of control over the configuration of the cable being towed by the vessel. However, cables equipped with segmented fairings cannot be conveniently fitted with a plurality of negative lift devices along the cable because the large number of negative lifting devices inferred from Blaisdell would preclude the use of continuous anti-strum fairing segments in accordance with the teaching of the Hale '976 patent.

SUMMARY OF THE INVENTION

It is a general purpose and object of the present invention to provide a means for achieving negative lift in a cable equipped with segmented fairings throughout a major portion of its length.

Another object of the present invention is to provide each fairing segment with its own negative lift device, and to allow for adjustments to be made in each of these lifting devices so as to achieve control of the lifting forces exerted on the cable in a manner that allows the lifting force on the cable to be distributed along the cable.

These objects are accomplished with the present invention by providing segmented fairings along a conventional towed cable such that the hydrodynamic drag forces on the cylindrically shaped cable are reduced. The fairing segments are provided with oppositely arranged the trailing portions, and at least one of these trailing portions is fitted with a projecting vane that extends perpendicular to the fairing face on which the vane is mounted. Means is provided for mounting these vanes to the fairing such that the vane can be oriented at a predetermined angle $\beta$ relative to the axis of the cable. The cable moves through the water at another angle $\alpha$ which is related to this predetermined angle $\beta$ and thereby achieves a predetermined negative lifting force of the water on the vane, which force in turn acts on the cable and its fairing to achieve a negative lift force on the cable that along the length of the cable.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DESCRIPTION OF THE PREFERRED EMBODIMENT

Figure 1:
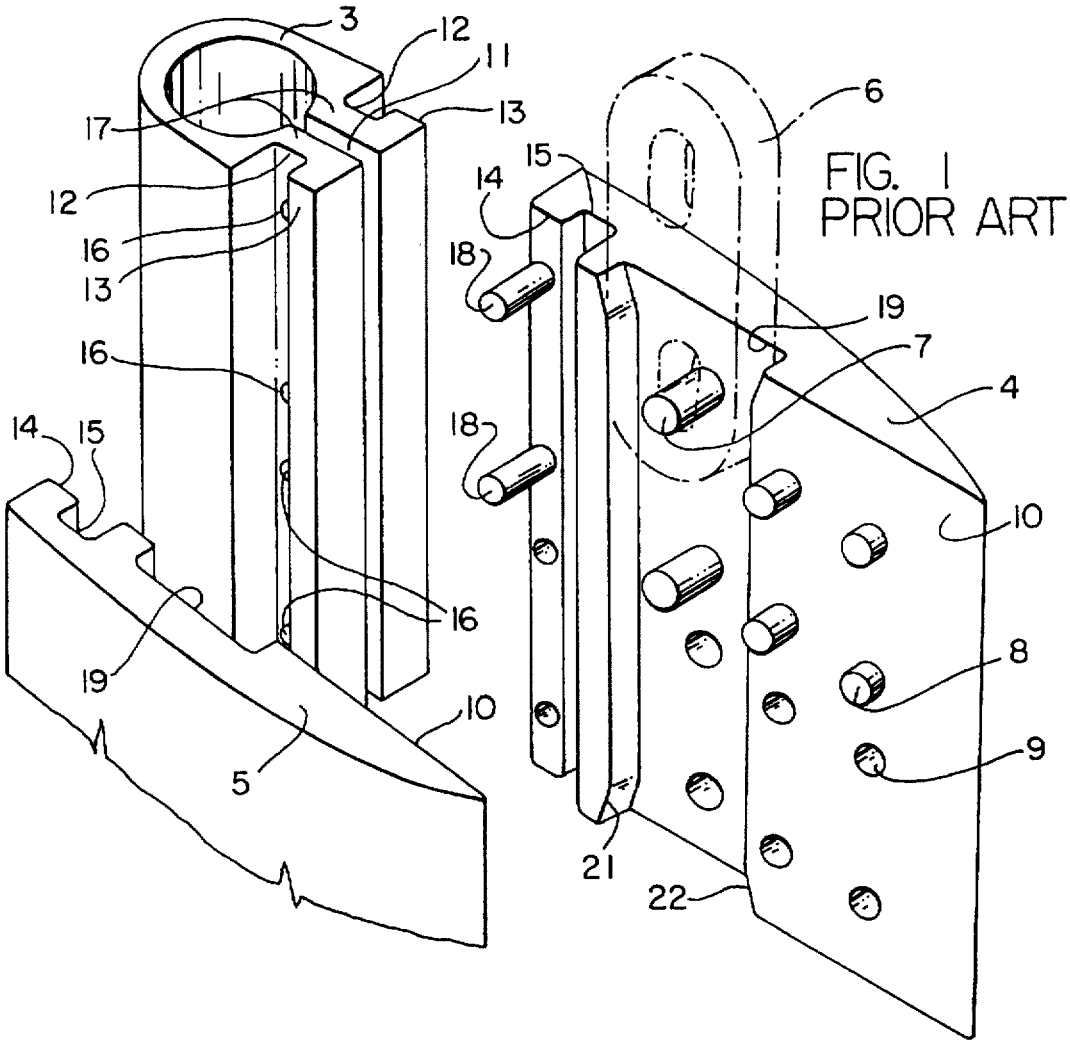
FIG. 1 PRIOR ART
FIG. 1 shows a segmented anti-strum fairing segment with the fairing components depicted in exploded relationship to illustrate its construction. This view has been taken from U.S. Pat. No. 3,611,976 in order to illustrate the background for the present invention.
Figure 3:
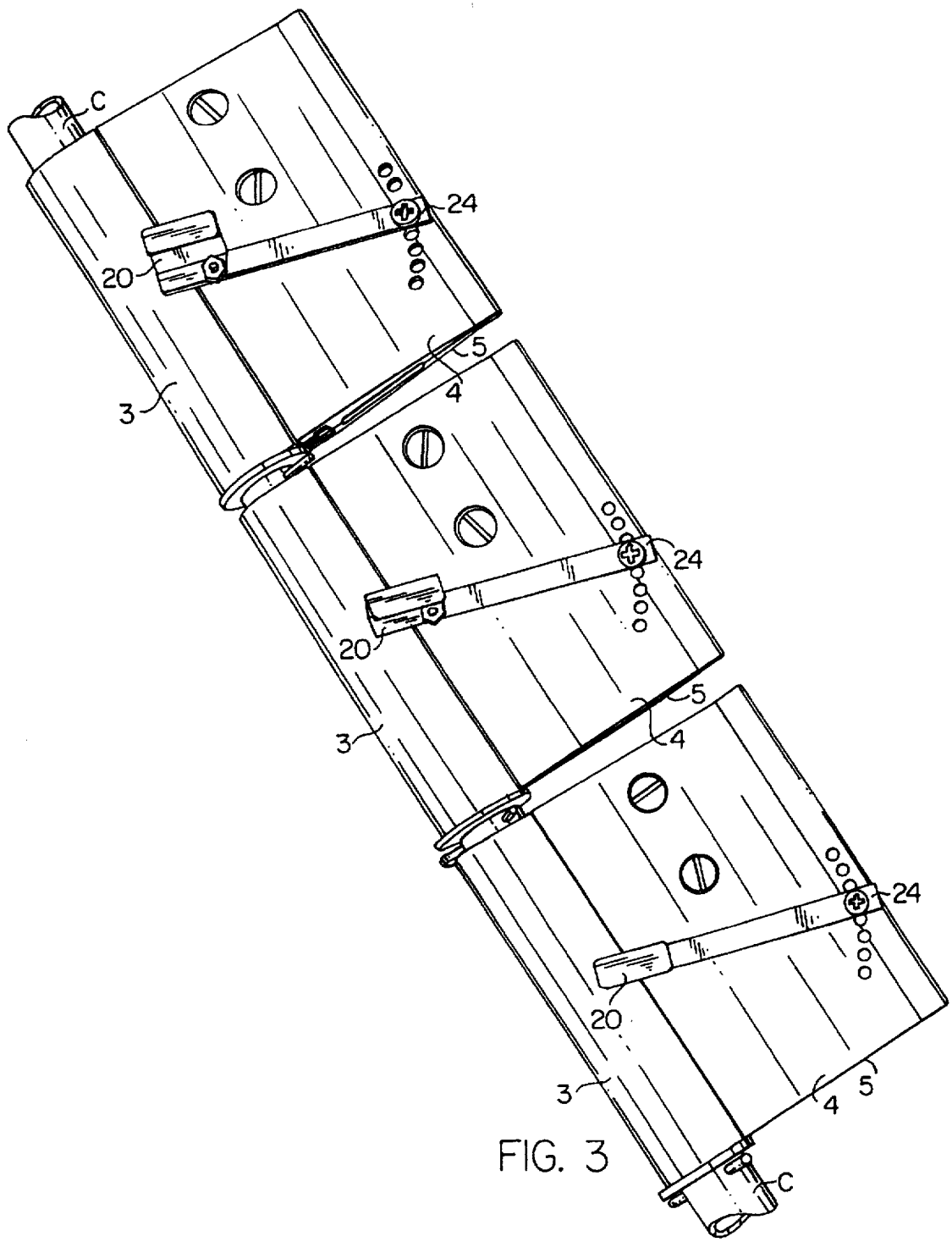
FIG. 3 is a view of several cable segments of the type fitted with negative lift devices of FIG. 2 provided on a towed cable.

Referring now to FIG. 1 in greater detail, this prior art cable fairing is adapted to be attached to a towed cable (not shown) and comprises a nose portion 3 adapted to interlock with a pair of similar tail portions 4 and 5. A link 6 may be used to connect adjacent sections of assembled fairings but this feature forms no part of the present invention, and in fact instead of a link these fairings may be independently secured to the cable by attachment collars as shown in FIG. 3.

Still with reference to the prior art fairing of FIG. 1, the tail portions 4 and 5 may be identical to one another except for registration pins 8 and registration holes 9 so arranged that when these tail portions are interfaced with one another the pins 8 register in the holes 9. These tail portions may be ultrasonically welded or in the alternative may be secured to one another by conventional fasteners.

As shown in FIG. 1, the nose portion 3 is also injection molded and has a split line 11 which permits the nose portion to be flexed open for purposes of wrapping it around the cable. Projections 13 on the nose member have externally open recesses 12 which are adapted to register with projections 14 on the tail portion, and the projections 13 of the nose portion are similarly received in recesses 15 defined for this purpose in the tail portions. The pins 18 and corresponding openings in the nose portions, indicated generally at 16, are intended to provide alignment for and to lend additional rigidity to the overall assembled structure. The channels 19 in the tail portions 4 and 5 provide space for the use of the links such as that depicted at 6 in FIG. 1.

Segmented fairings of the type described above with reference to FIG. 1 are designed basically to streamline the cable as it is towed through the water. In theory, a continuous fairing molded to the cable would be ideal. In practice, however, it has been found that a sectionalized or segmented fairing is more practical and is more conveniently stowed on a drum or reel aboard the vessel. These fairings can have a drag coefficient of approximately 0.06 as compared to the drag coefficient of the cylindrical cable itself that might run as high as 1.2. Actually, the drag may be higher than indicated by a comparison of drag coefficients because vibration of the cable is created when the cable is towed at relatively high speed and at a steep angle relative to the horizontal. Therefore, there is a need for fairings of the type shown in FIG. 1 to be used with towed cables generally. The present invention provides a unique negative lift component for each fairing segment of the type described above.

Figure 2:
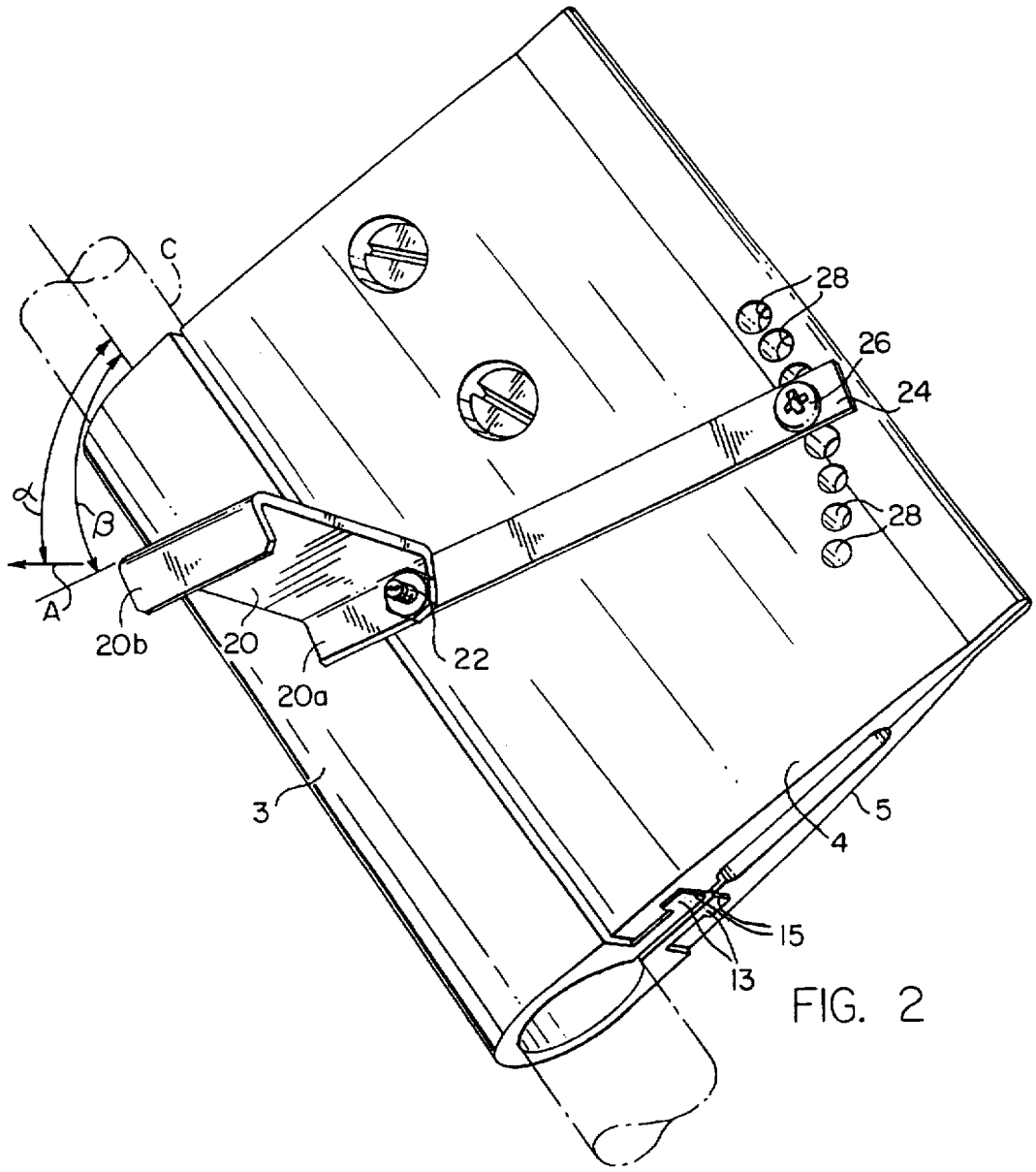
FIG. 2 shows an assembled anti-strum fairing similar to that of FIG. 1 above but with a negative lift device secured to one face of the fairing in accordance with the present invention.

Turning next to FIG. 2, the fairing segment of FIG. 1 is shown in assembled relationship with a cable C. The nose portion 3 is assembled with tail portions 4 and 5 by virtue of the T-shaped projection 13,13 on the nose portion fitted in the slots 15,15 of the tail portions 4 and 5. For reference purposes the cable C is shown in phantom lines in FIG. 2. Assuming that the cable C is towed through the water in the direction generally of the arrow A, it will be apparent that the fairing would exert a streamlined drag reducing influence on the cable and also prevent lateral vibration of the cable due to hydrodynamic forces generally. In accordance with the present invention a vane 20 is provided on each side of the fairing and is oriented at a slight downward angle relative to the direction A so as to exert a downward force on the fairing and hence on the cable. When each fairing segment is equipped with such vanes it will be apparent that the downward force on the cable can be continuous along its length unlike the downward force achieved with single prior art depressor devices of the type described hereinabove.

Each vane 20 is mounted to the fairing by a fastener 22 which extends through the fairing assembly alongside the cable C as shown. The vane 20 can be pivoted on the axis of the fastener 22 and a support strap 24 is provided on the inboard end of the vane 20 for this purpose. The vane 20 is preferably of channel shape having inboard and outboard winglets 20*a* and 20*b* respectfully. The inboard winglet 20*a* is secured to the strap 24 so that the strap can be pivoted between various positions as determined by the location for a locking device preferably in the form of a screw fastener 26 provided in the end of the strap 24 adjacent to the trailing edge of the fairing. A plurality of openings 28,28 are defined in the trailing edge of the fairing for this purpose. These openings 28,28 are arranged in an arc which has as it center the pivot screw 22. A look screw 26 is provided in any one of the several openings 28 for orienting the vane 20 at a predetermined angle β relative to the longitudinal axis of the cable C. Knowing the angle of the cable α relative its direction of movement in the cable as it is towed beneath the water one can arrange the vane 20 at the predetermined angle β relative to the directional of fluid flow A. The angle of the vane 20 relative to the cable axis C is therefore related to the angle between the cable axis and the flow A. The downward force on the vane 20 depresses the cable relative to its normal position and leads to use of a shorter cable scope for a given speed of travel of the vessel and a given weight of the component being towed than would be the case utilizing a cable fitted only with the prior art segmented fairings, that is without the negative lifting devices, of the present invention.

Figure 4:
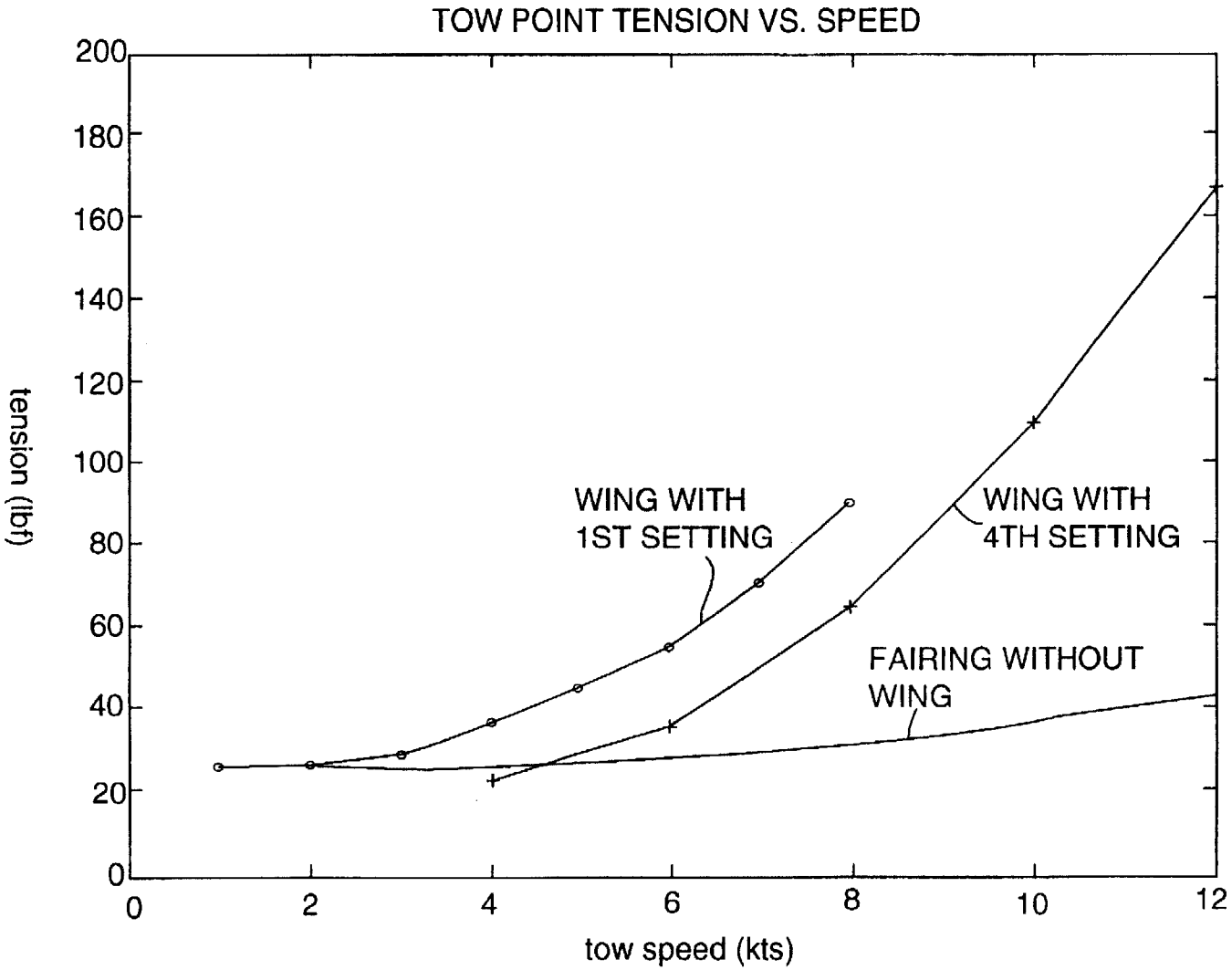
FIG. 4 is a plot of tow cable speed vs. cable tension.

FIG. 4 shows the effect of cable tension on towing speed with the reference line illustrating the fairing without negative lift devices applied thereto. Here again with fairing vane at a setting and for comparison at a fourth setting to show the effect on cable tension at particular towing speeds.

Figure 5:
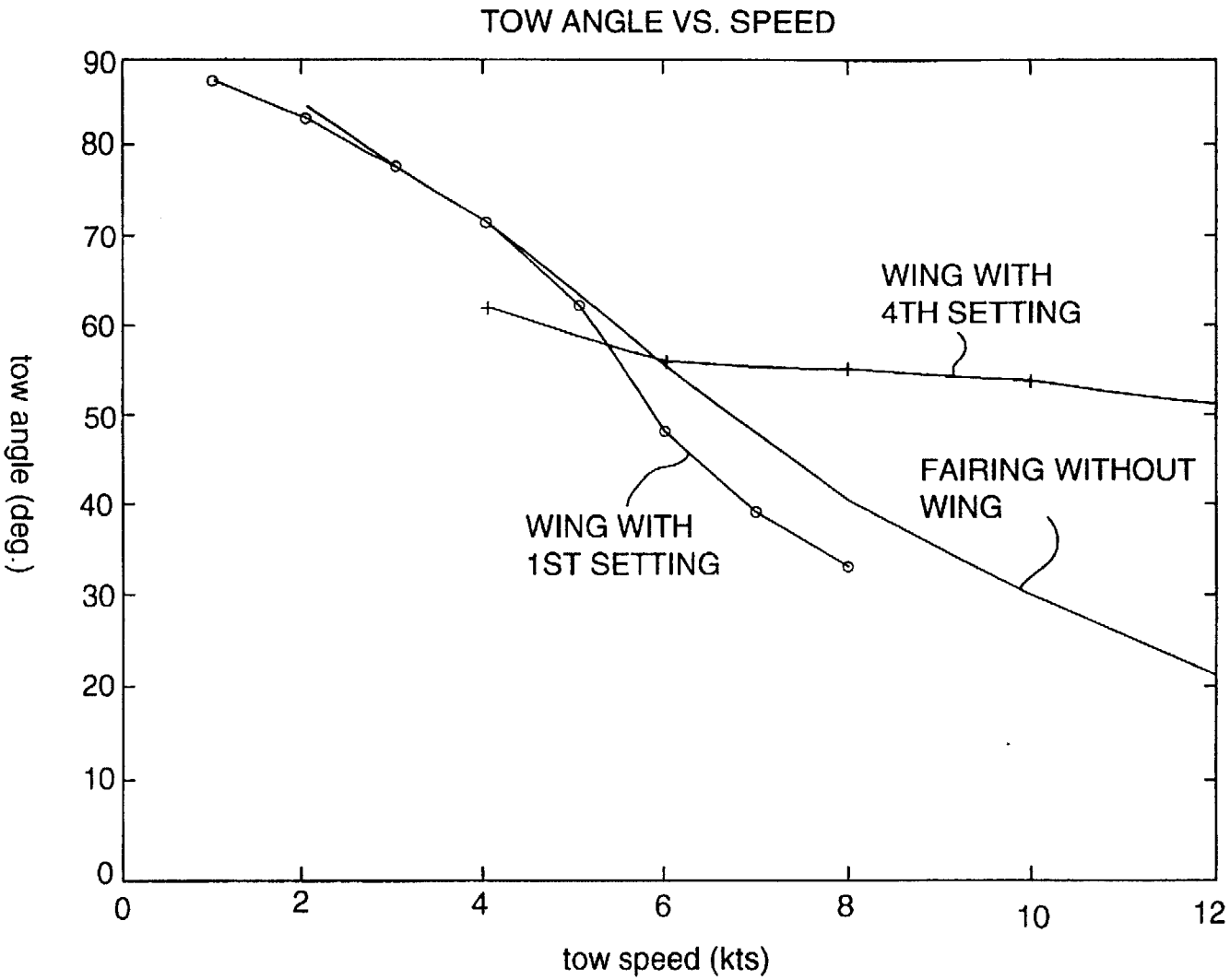
FIG. 5 is a plot of tow cable angle $\alpha$ vs. tow cable speed.

FIG. 5 illustrates the effect of tow angle on speed with the cable having fairings without lifting devices of the present invention versus cable with such fairings and fitted with the negative lift device of the present invention at different settings (that is as a result of varying the angle of the vane on the fairings between a first setting and a fourth setting). FIG. 5 illustrates that a cable can be towed at a constant angle over a wide range of tow speeds with such a fairing.

Obviously modifications and variations of the present invention will become apparent in light of the above teachings. Other means may be provided for varying the angle of the vane with respect to the axis of the cable mounted on the fairing.

In light of the above it is therefore understood that within the scope of the appended claims the invention may be practiced otherwise than as specifically described.

What is claimed is:

1. In combination with a cable fairing of the type provided in segments on a cylindrically shaped submersible towed cable for reducing hydrodynamic drag forces on the cylindrically shaped cable as a result of towing the cable when the axis of said cable is oriented at an angle α to the direction of movement of the cable, the fairing comprising oppositely arranged fairing tail portions and a nose portion adapted to be secured to said cable and to surround said cable so that trailing portions thereof provide a generally symmetrical foil shade, each cable fairing segment of said cable fairing having two sides and each of said two fairing sides having a projecting vane that extends outwardly of at least one fairing portion, and means for mounting said vane to said fairing portion such that the vane is oriented at a predetermined angle β with the axis of said cable wherein the angle is adjustable, and wherein angle β is greater than angle α so as to provide a negative angle of attack and hence a depressive force on the cable segment associated with each of said segments of said cable fairing and whereby an angle of attack of the vane is provided, said angle of attack defined by the difference between the angles $\alpha$ and $\beta$ and said vane being pivotably mounted to said fairing portion at one of a plurality of different angles of the vane relative to the cable axis.

2. The combination according to claim 1 which is further characterized by a support strap for mounting said vane to said fairing portion, and pivot means being provided adjacent the trailing edge of said vane, said vane having a generally channel shape with downturned winglets at each end, one of which winglets is secured to one end of said strap and the other of which winglets is provided at the outboard end of said vane.

3. The combination according to claim 2 wherein said means for securing said strap in one of said plurality of positions comprises a locking device adjacent the trailing edge of the fairing, said fairing defining a plurality of openings for receiving said device in a plurality of alternative positions to vary the angle $\beta$ and thereby allow variations in the angle $\alpha$ at different locations on the tow cable.

4. The combination according to claim 3 wherein said pivot means comprises a fastener extending through said fairing adjacent the cable receiving nose portion of said fairing.

5. The combination according to claim 4 wherein said pivot means comprises an elongated fastener that also mounts said strap to said fairing.

* * * * *